United States Patent [19]

Funck et al.

[11] Patent Number: 4,642,584

[45] Date of Patent: Feb. 10, 1987

[54] SLOT-LINE SWITCHING AND LIMITING DEVICE FOR OPERATION AT MICROWAVE FREQUENCIES

[75] Inventors: Ronald Funck, Port Marly; Jean Stévance, Aulnay sous Bois, both of France

[73] Assignee: Thomson-CSF, Paris, France

[21] Appl. No.: 696,769

[22] Filed: Jan. 31, 1985

[30] Foreign Application Priority Data

Feb. 24, 1984 [FR] France ..... 84 02853

[51] Int. Cl.[4] ..... H01P 1/15; H01P 1/22

[52] U.S. Cl. ..... 333/17 L; 333/223; 333/238; 333/247; 333/262

[58] Field of Search ..... 333/103, 104, 17 L, 333/238, 246, 247, 258, 262; 331/107 SL; 329/160, 161; 455/327

[56] References Cited

U.S. PATENT DOCUMENTS

| | | | |
|---|---|---|---|
| 2,923,901 | 2/1960 | Robertson . | |
| 3,568,105 | 3/1971 | Felsenheld . | |
| 3,914,713 | 10/1975 | Konishi et al. . | |
| 3,995,239 | 11/1976 | Head et al. | 333/246 X |
| 4,425,549 | 1/1984 | Schwartz et al. | 333/247 X |
| 4,541,120 | 9/1985 | Szabo | 331/107 SL X |

FOREIGN PATENT DOCUMENTS

| | | |
|---|---|---|
| 0028403 | 5/1981 | European Pat. Off. . |
| 2451641 | 10/1980 | France . |
| 81/01080 | 4/1981 | PCT Int'l Appl. . |

OTHER PUBLICATIONS

1982 IEEE MTT-S International Microwave Symposium Digest, "New Structures for Impedance Transformation in Fin-lines" H. El Hennawy, et al, Jun. 15-17, 1982, pp. 198-200.

1981 IEEE MTT-S International Microwave Symposium Digest, "Computer-Aided Design of Semiconductor Mounts in Fin-line Technology" H. El Hennawy, et al, pp. 307-309.

*Primary Examiner*—Paul Gensler

[57] ABSTRACT

A slot-line for a microwave device in which is mounted at least one diode connected in parallel between two metallic strips of the slot. At high frequencies (18 to 200 GHz), the inductance L of the diode connections presents a not-negligible impedance which makes it difficult to use the diode. The device in accordance with the invention comprises a slot-line reentrant circuit which provides compensation for the diode inductance and is constituted by a metallic section which is coplanar with the line and connected in series with the diode. The compensating section is short-circuited or open-circuited with respect to the metallic strip in which it is reentrant. The electrical length of the compensating section is adjustable by means of wire, conductive varnish or metal pads.

7 Claims, 12 Drawing Figures

FIG. 1
PRIOR ART
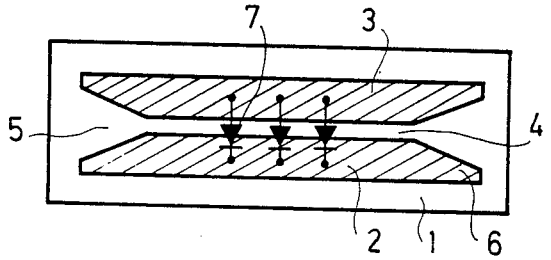
FIG. 2
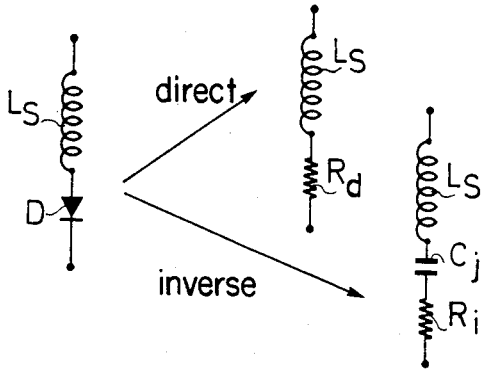
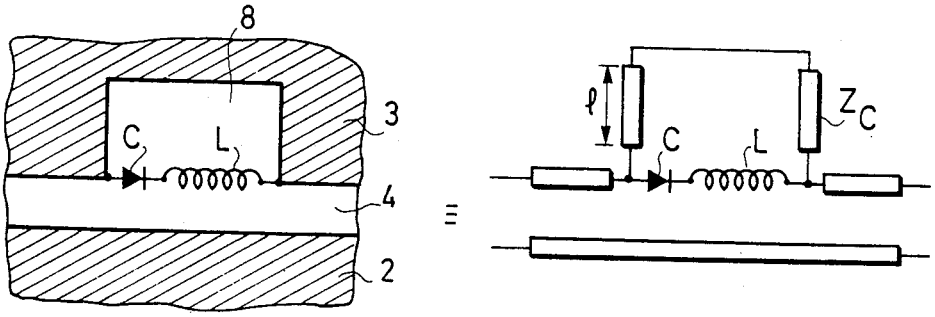
FIG. 3 PRIOR ART

SLOT-LINE SWITCHING AND LIMITING DEVICE FOR OPERATION AT MICROWAVE FREQUENCIES

BACKGROUND OF THE INVENTION

1. Field of the Invention

The present invention relates to a slot-line switching and limiting device which operates in the micro- wave-frequency range. This device operates in different modes according to whether the diodes which form part of the device are forward or reverse-biased. Depending on the mode of operation, this device attenuates the input microwave signal either partially (limiter) or totally (switch). In this device, the invention is essentially concerned with the circuit for compensating the reactive elements associated with each diode, that is to say its parasitic resistance, its self-inductance related to the connections and its reverse-bias capacitance.

2. Description of the Prior Art

Slot-lines (also known as slotted lines or finlines) are constituted by two metallization layers deposited on an insulating substrate such as quartz, alumina or a plastic substrate, a slot having a width of 100 to 200 microns being left between said layers. This circuit behaves as a waveguide within the frequency range of 18 to 200 GHz, for example. There are different ways of mounting one or a number of diodes in order to construct a circuit of this type in the form of an attenuator, a switch, or a limiter. The diodes employed are usually pin diodes or Schottky barrier diodes and are connected either by beam leads or wires. At microwave frequencies, these connections possess a self-inductance which has a predominant influence on the characteristics of the circuit.

SUMMARY OF THE INVENTION

The object of the invention is to compensate for the self-inductance aforesaid by means of a tuning or compensating circuit which takes into account the reactive elements associated with each diode. Compensation is obtained by means of a coplanar line circuit in series with the diode which is mounted in parallel between the two strips of the slot-line, this circuit being composed of at least one coplanar line section of adjustable length.

In accordance with improvements to the invention, the circuit comprises two line sections per diode in a proportion of one section for each diode connection. In addition, one section can be open or in other words isolated from the adjacent strip, thus making it possible to apply an independent bias voltage to the diode.

In more precise terms, the invention relates to a slot-line switching and limiting device for operation at microwave frequencies, comprising two metallized strips which are supported on a substrate and define a slot between them, and at least one diode which is mounted in parallel between the two strips and has an inductance L produced by the connections in addition to its resistance R and its junction capacitance C. The device in accordance with the invention is distinguished by the fact that, in order to compensate for the impedance presented by the inductance L at high frequency, provision is made for a compensation element constituted by at least one metallic section which is coplanar with the slot-line, connected in series with the diode and adjustable for length, said metallic section being inscribed within a zone formed in one strip from which it is separated by at least two nonmetallized strips.

BRIEF DESCRIPTION OF THE DRAWINGS

Other features of the invention will be more apparent upon consideration of the following description and accompanying drawings, wherein:

FIG. 1 is a simplified representation of a slot-line or fin-line in accordance with the prior art;

FIG. 2 is a diagram showing equivalent arrangements of a diode;

FIG. 3 is a diagram illustrating a circuit arrangement for compensation of a series diode in a slot-line in accordance with the prior art;

DESCRIPTION OF THE PREFERRED EMBODIMENTS

Figure 4:
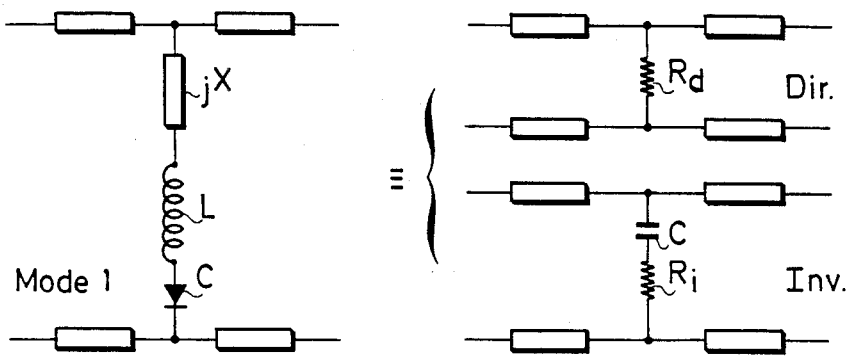
FIGS. 4 and 5 are diagrams showing equivalent circuit arrangements for compensation of a parallel diode in a slot-line in accordance with the invention.

As shown very schematically in FIG. 1, the slot-line or fin-line circuit arrangement comprises a casing provided with suitable connections and containing a substrate 1 of dielectric materials (quartz, alumina) on which are deposited two metallic strips 2 and 3, a slot 4 being left between the two strips. The ends of the metallization deposits have two impedance-matching zones 5 and 6 which constitute transition zones between the external circuit and the slot-line circuit. One or a number of diodes 7 are mounted in a bridge connection between the two metallization deposits 2 and 3. In order that the circuit may be employed with diodes, one of the metallization deposits, designated by the reference 3 in this figure, is isolated in order to permit the supply of a direct-current bias voltage. On the other hand, from a high-frequency standpoint, the aforementioned metallization deposit 3 is connected to ground, and deposited on a dielectic wall having a thickness equal to $\lambda_d/4$, where $\lambda_d$ is the wavelength in the dielectric medium considered.

In order to form a characteristic impedance which is matched with the impedances of the diodes, the width of the slot is within the range of 100 to 200 microns. In order to minimize insertion losses, the circuit assembly must be as short as possible. By way of example, the length of the slot 4 is of the order of 5 millimeters or less and the two transition regions are of the order of 12 millimeters or less.

In a slot-line switching or limiting circuit, the basic circuit is constituted by one or a number of diodes in parallel on the slot-line as shown in FIG. 1. These diodes can be mounted in a beam-lead structure, that is to say with the beam leads soldered in a flat position. Capacitances of the order of 0.02 pF permit operation of said diodes up to very high frequencies such as 200

GHz, for example. They can also be of the conventional type with a chip connected by means of a wire bonded by thermocompression. The diodes in this case have a capacitance which is higher than or equal to 0.1 pF and are capable of operating only at lower frequencies, depending on the capacitance of the diode, that is to say in the vicinity of 18 GHz. The diodes which can be employed are pin diodes or Schottky-barrier diodes. Especially at very high frequencies, however, pin diodes must be considered as perfect diodes since they have low capacitance in reverse bias and low resistance in forward bias when associated with a series-connection inductance L, namely the inductance of the beam lead or of the wire connection.

The foregoing arrangement is shown in FIG. 2, in which a diode D is represented by its conventional symbol in series with an inductance $L_S$ which is constituted by the connection wire. If the diode is forward-biased, its impedance is equal to the sum of the resistance $R_d$ of the diode in the forward direction, and of the inductance $L_S$. If the diode is reverse-biased, its impedance in that case is equal to the sum of the resistance $R_i$ plus the junction capacitance $C_j$ of the reverse-biased diode in series with the inductance $L_S$ of the connections.

At high frequencies, the impedance presented by the inductance coil is not negligible and makes it increasingly difficult to use the diode when the frequency rises. A circuit element for compensating the inductance $L_S$ must therefore be associated with the diode. The invention is accordingly directed to a particularly simple method for carrying out this compensation in slot-line circuits, said compensation being very readily adjustable in order to tune the circuits to the desired frequency.

Before entering into a detailed description of the invention, however, it is first necessary to define the two modes of operation of the circuit in accordance with the invention since the designation of these modes will frequently be employed in the description which now follows.

In operating mode 1 of the circuit in accordance with the invention, the switch is open, which means that isolation is achieved when the diode or diodes are forwardbiased. The switch is in the conducting state and there are consequently only low insertion losses when the diode or diodes are reverse-biased. This operating mode is compatible with operation as a passive limiter. An increase in input signal power initiates an injection of carriers into the diodes and therefore an increase in losses, thus resulting in a limitation in output power.

In operating mode 2, which is the reverse of the preceding mode, the switch is open, which means that isolation is effected when the diodes are reverse-biased. The switch is in the conducting state and there are therefore only low losses when the diodes are forwardbiased. This mode is incompatible with operation as a passive limiter.

In the description given hereinafter, the two modes referred-to in the foregoing will be designated respectively as mode 1 and mode 2.

In the use of beam-lead pin diodes, the equivalent inductance of the beam leads of the diode has a predominant influence. The presence of said inductance has the following consequences:

lower impedance than the diode in reverse bias than in forward bias, thus resulting in difficult operation in mode 1 which is the only possible mode in passive limitation. The construction of circuits in mode 1 in which non-compensated diodes are employed therefore entails the need for very fine slots (100 microns), which are difficult to form or else calls for a structure comprising three diodes and consequently involving high losses;

high insertion losses in the forward direction in mode 1 when the diodes are reverse-biased on account of the proximity of resonance between the junction capacitor $C_j$ and the inductance coil;

low power-handling capability of the reverse-biased diode in the breakdown region on account of the overvoltage of the junction capacitance-junction impedance circuit. These considerations essentially entail the use of a compensation reactive circuit which serves to compensate the reactive elements associated with the pin diodes.

FIG. 3 is a schematic diagram showing the arrangement adopted for compensation of a series diode in a slot-line in accordance with the prior art. The left-hand portion of FIG. 3 shows the diode mounted within the slot and the right-hand portion represents the electric circuit diagram which is equivalent to the arrangement shown on the left.

In regard to FIG. 3 as well as FIGS. 6 to 12, it will be understood that these figures represent only the portion of the slot-line located in the region which surrounds the diode.

In a series diode circuit of this type, the diode as represented by its capacitance C and the inductance L of its connection is mounted between the opposite edges of a zone 8 formed in a metallic strip 3, for example. Said zone 8 is therefore constituted by the substrate without any metallization deposit. If the depth of the zone 8 has a length l, the metallic strip 3 constitutes at the diode terminals a section or so-called stub which is short-circuited since it is formed in the same metallic zone having a characteristic impedance $Z_c$ and a length l and which is connected in parallel to the diode and connection impedance assembly. The circuit formed in the zone 8 is so adjusted as to ensure that:

in reverse bias, series resonance occurs between the capacitance C of the diode and the connection inductance L, in which case the switch is in the conducting state;

in forward bias, parallel resonance occurs between the connection inductance L and the short-circuited stub, in which case the switch is in the non-conducting state. This known type of circuit does not operate efficiently at 94 GHz, whereas this frequency is particularly advantageous since it corresponds to a transmission window in the atmosphere. The chief problems arise from the fact that it is a very difficult matter to fulfil the two tuning conditions at this frequency and that it is in fact materially impossible to satisfy both conditions at the same time.

Figure 5:
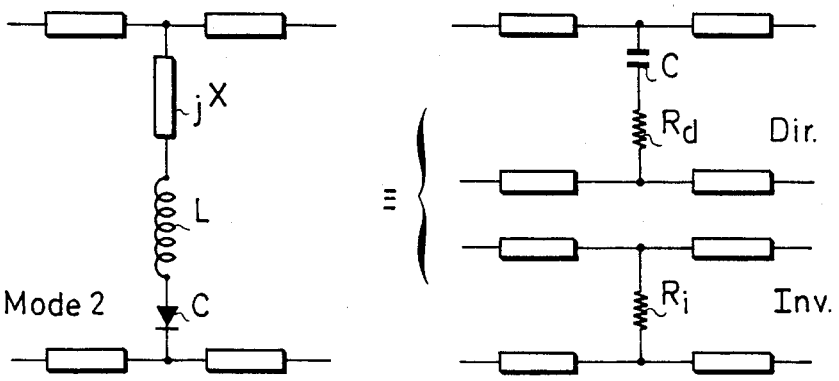

The method in accordance with the invention is represented by the schematic diagrams of equivalent circuit arrangements for compensation of a parallel diode in a slot-line as shown in FIGS. 4 and 5. The left-hand portion of these figures is a schematic presentation of the actual construction of the diode whilst the right-hand portion of each figure shows the equivalent arrangements in mode 1 in the case of FIG. 4, and in mode 2 in the case of FIG. 5.

In accordance with the invention, at least one pin diode is mounted in parallel in the slot of the slot-line by associating therewith a series reactive element jX (j being the symbol of the imagineries) having the intended function of compensating the reactive elements which are associated with the diodes. In both types of circuit, the assembly constituted by the diode, its connection inductance and the tuning or compensating component jX has a value of reactance defined in the forward direction. It is therefore necessary either to associate matching circuits with the diode or to employ a minimum of two diodes placed at a suitable distance on the slot-line.

The ideal series compensation element which produces the widest operating band is a localized element. In mode 2 as shown in FIG. 5 in which the element is intended to be inductive, it can readily be formed by increasing the length of the diode connection, for example. On the other hand, in mode 1 in which said element is intended to be capacitive in order to tune the diode connection inductance, it is not possible to construct said element in the form of a localized etched or added capacitor since this latter would have dimensions in the vicinity of a quarter-wavelength. The use of a localized capacitor which is added to the circuit gives rise to problems of reproducibility and of technological complexity.

The solution provided by the invention consists in carrying out the necessary compensation by means of an etched line section which is coplanar with the strips of the slot-line on the common substrate.

Figure 6:
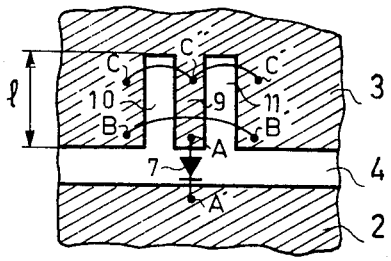
FIG. 6 illustrates a slot-line compensated by a coplanar resonator in accordance with the invention.

FIG. 6 illustrates the central portion of a slot-line compensated by a coplanar resonator in accordance with the invention. Since the slot-line 4 is constituted by two metallic strips 2 and 3 deposited on a substrate, a reentrant coplanar line 9 is formed in one of the two strips, namely the strip 3, for example. This reentrant coplanar line constituted by a metallization section 9 is obtained simply by etching two zones 10 and 11 in the metal of strip 3. The section 9 has a length l obtained by etching.

The diode 7 is connected between the two points A and A′ located at the free end of the section 9 and on the opposite metallic strip 2. In accordance with an improvement to the invention, an aerial lead wire provides a bridge connection between the two edges of the metallic strip which comprises the reentrant section 9. This lead wire connected between the points B and B′ makes it possible to equalize the potentials at said points. Furthermore, since the diode is connected between A and A′, the length of the compensating section 9 may if necessary be adjusted by means of a wire which is thermocompressed between the points C, C′ and C″ at a location which is variable according to the compensation desired. The length of the compensating section 9 can also be obtained by depositing at the bottom of the zones 10 and 11 which have been etched in the metallization deposit 3, in the vicinity of the points C, C′ and C″, a silver lacquer which short-circuits the section 9 to a greater or lesser extent.

Further embodiments of the invention will be shown in the following figures but this type of compensation circuit has advantages which are common to all these embodiments and are as follows:

etching of the substrate on only one face which is therefore coplanar;

easy adjustment of the circuit by modifying the electrical length of the sections, this being achieved by thermocompression of a wire or deposition of a conductive lacquer. This type of circuit permits the achievement of higher performances and better repro- ducibility.

The impedance of the section or stub 9 is equal to:

$$jZ_c \operatorname{tg} \frac{\omega l}{v}$$

with:

$Z_c$=characteristic impedance of the coplanar line, $\omega$=angular frequency, l=length of section, v=velocity of propagation of the wave in the medium.

Given that $$\omega = \frac{2\pi l}{\lambda},$$

where $\lambda$ is the wavelength at the frequency of the device, $$\text{if } \frac{2\pi l}{\lambda} < \frac{\pi}{2}$$

that is, if $l<\lambda/4$, the device is inductive, $$\text{if } \pi > \frac{2\pi l}{\lambda} > \frac{\pi}{2}$$

that is, if $\lambda/2>l>\lambda/4$, the device is capacitive.

Figure 7:
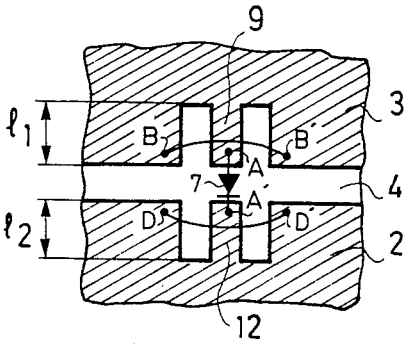
FIGS. 7 and 8 illustrate a slot-line compensated by a coplanar resonator in two other embodiments of the invention.

FIG. 7 shows the central portion of a slot-line compensated by a coplanar resonator in a second embodiment. Since the diode is mounted between the points A and A′ as shown in FIG. 6, the point A forms part of a first section 9 of length $l_1$ but the point A′ forms part of a second section 12 of length $l_2$. The lengths $l_1$ and $l_2$ are separately adjustable and, if $l_1=l_2$, the impedance in series with the diode is $$2jZ_c \operatorname{tg} \frac{\omega l}{v}.$$

It will be readily apparent that, in the event that the diode is mounted between two line sections 9 and 12, there are two wires for ensuring equipotentiality between the points B, B′ and D, D′ on each side of the slot.

Figure 8:
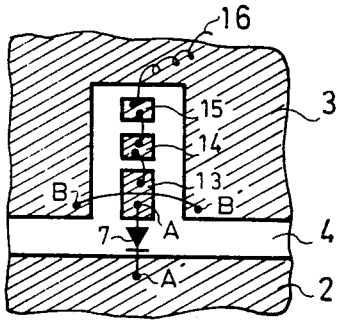

FIG. 8 illustrates a third alternative embodiment of the invention. Whereas in the case of FIGS. 6 and 7, the section or sections or stubs 9 and 12 were in short-circuit, the section is in the open-circuit condition in the case of FIG. 8 and is constituted by at least one section 13 although it is preferable to add to this latter at least one section element 14. A preferable solution consists in adding a plurality of small sections such as those designated by the references 14, 15, each section being isolated on the substrate. The open-section solution permits easier biasing of the diode which is mounted between the points A and A′ as in the previous instance. This bias is provided by means of a wire 16 which is either soldered or thermocompressed on one of the sections 13, 14 or 15, the total length of the section being chosen by bridging between the elementary sections so as to compensate the diode. The definitions being the same as those given with reference to FIG. 6, the impedance of the compensation circuit in accordance with FIG. 8 is given by:

$$-jZ_c \operatorname{cotg} \frac{\omega l}{v}$$

If $l<\lambda/4$, the compensation line is inductive.

If $\lambda/2>l>\lambda/4$, the compensation line is capacitive.

The circuit of FIG. 8 can be constructed with two symmetrical and open sections or stubs. In other words, the symmetrical arrangement of FIG. 7 with two sections in short-circuit in accordance with FIG. 6 can also be realized with two open-circuit sections in accordance with FIG. 8.

Figure 9:
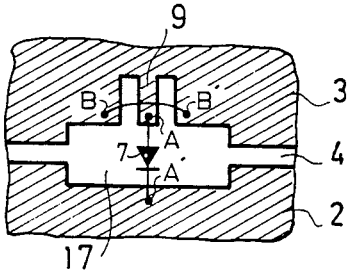
FIG. 9 illustrates a slot-line in accordance with the invention and comprising a single diode.

FIG. 9 represents a diode circuit arrangement in accordance with the invention for operation both in mode 1 and in mode 2. In this arrangement, a high-impedance section 17 is inserted at the level of the diode in the slot-line. This section is intended for matching in the conducting state in order to correct the impedance of the diode which is not sufficiently high.

In mode 1, the assembly consisting of diode and compensation line is equivalent to a short-circuit for the diode when forward-biased. Since the codification is always the same, we have in this case:

$$L_S\omega + Z_c \operatorname{tg} \frac{\omega l}{v} = 0$$

In the case of operation in mode 2, both the diode and the compensation are equivalent to a short-circuit for the reverse-biased diode, in which case we have:

$$L_S\omega - \frac{1}{C_J\omega} + Z_c \operatorname{tg} \frac{\omega l}{v} = 0$$

Figure 10:
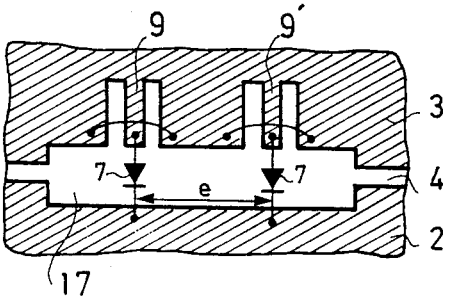
FIG. 10 illustrates a slot-line in accordance with the invention and comprising two diodes.

FIG. 10 shows the central portion of a two-diode slot-line in accordance with the invention. In this alternative arrangement, the two diodes are mounted in a high-impedance section 17 in the same manner as in the case of FIG. 9 but are located with respect to each other at a distance "e" corresponding to a relative spacing which is optimized for matching in the forward direction if the diodes are reverse-biased. However, it is possible to have the same arrangement by maintaining the same slot width along the entire length of the line.

Figure 11:
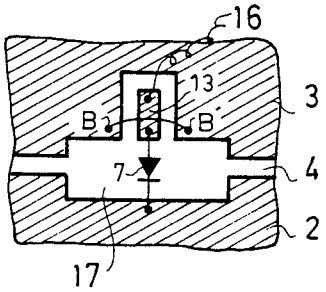
FIG. 11 illustrates a slot-line in accordance with the invention and comprising a single diode with an open-circuit section.

FIG. 11 illustrates the central portion of a single-diode slot-line with an open-circuit section. The diode is biased through the section 13 via an external connection 16 and, in the case of this illustrative example, taking into account the operation in mode 1 and of the high-impedance section 17, we have the following equation:

$$L_S\omega - Z_c \operatorname{cotg} \frac{\omega l}{v} = 0$$

Figure 12:
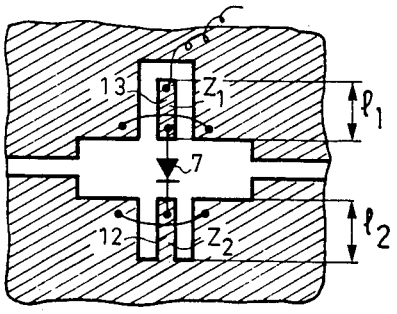
FIG. 12 illustrates a slot-line in accordance with the invention and comprising a single diode with two types of section.

Finally, FIG. 12 is a schematic illustration in which the two types of sections are employed for compensating the diode. Since the diode is mounted between a short-circuited section 12 having a characteristic impedance $Z_2$and a length $l_2$and an open-cirquit section 13 having a characteristic impedance $Z_1$ and a length $l_1$, the impedance of the compensation line is equal to:

$$L_S\omega + Z_2 \operatorname{tg} \frac{\omega l_2}{v} - Z_1 \operatorname{cotg} \frac{\omega l_1}{v} = 0$$

The circuit in accordance with the invention essentially finds two types of application. A first type comprises the switching circuits such as a break switch, an n-channel changeover switch having low and intermediate levels. A second type comprises the passive limitation circuits or in other words non-controlled medium-power circuits. Among the practical applications of the first type including controlled break-switches and changeover switches, it is sought to obtain two operating states by virtue of an external bias, namely a low-loss conducting state and a high-isolation non-conducting state. These two states can be obtained by means of the two operating modes 1 and 2 which have been defined in the foregoing.

In the case of passive limiters, the diodes are self-biased by means of a direct-current return which is external to the microwave circuit. In this case, the diodes are self-biased in the forward direction progressively as the microwave power increases. The use of a circuit in mode 1 is imperative in order to have an operation as a passive limiter. In more general terms, the line and slot device for limiting or switching in accordance with the invention is employed in telecommunication equipment, radars or microwave missile guidance.

What is claimed is:

1. A slot-line switching and limiting device for a slot-line operating at microwave frequencies, comprising: two metallized strips which are supported on a substrate and which define a slot therebetween, at least one diode which is mounted in parallel between the two strips and has an inductance produced by connections, a resistance and a junction capacitance, and a compensating element for compensating for the impedance presented by the inductance at high frequency, said element being constituted by at least one metallic section which is coplanar with the slot-line, connected in series with the diode and adjustable for length, said metallic section being inscribed within a zone formed in one of said strips from which said metallic section is separated by at least two non-metallized strips.

2. A device according to claim 1, wherein the compensating element is short-circuited with a strip of the slot-line at an end of said element opposite to the end to which the diode is connected.

3. A device according to claim 1, wherein the compensating element is open-circuited with respect to the strip of the adjacent slot-line, thus making it possible to apply a bias voltage to the diode.

4. A device according to claim 1, wherein the compensating element is short-circuited with a strip of the slot-line, and wherein the electrical length of the element if adjustable by means of a wire which is thermocompressed between the element and the edges of the strip.

5. A device according to claim 1, wherein the compensating element is short-circuited with a strip of the slot-line, and wherein the electrical length of the element is adjustable by means of a conductive varnish deposited on the non-metallized strips between the element and the edges of the strip.

6. A device according to claim 1, wherein the compensating element is open-circuited with respect to the adjacent strip, the electrical length of the element is adjustable by means of at least a second element connected by means of a thermocompressed wire with the element to which the diode is connected.

7. A device according to claim 1, wherein said compensating element is constituted by two metallic sections, and wherein the diode is connected between said two sections, one of said sections being reentrant and inscribed in one of said strips, and the other section being reentrant and inscribed in the other strip.

* * * * *